US008717275B2

(12) United States Patent
Masui

(10) Patent No.: US 8,717,275 B2
(45) Date of Patent: May 6, 2014

(54) ELECTRO-OPTICAL DEVICE DRIVER CIRCUIT, ELECTRO-OPTICAL DEVICE, AND ELECTRONIC APPARATUS WITH A SHORTENED OFF SEQUENCE

(75) Inventor: Junichi Masui, Fujimi-cho (JP)

(73) Assignee: Seiko Epson Corporation, Tokyo (JP)

( * ) Notice: Subject to any disclaimer, the term of this patent is extended or adjusted under 35 U.S.C. 154(b) by 202 days.

(21) Appl. No.: 13/299,722

(22) Filed: Nov. 18, 2011

(65) Prior Publication Data

US 2012/0127152 A1 May 24, 2012

(30) Foreign Application Priority Data

Nov. 24, 2010 (JP) ..... 2010-261129

(51) Int. Cl.
*G09G 3/36* (2006.01)

(52) U.S. Cl.
USPC ..... 345/100

(58) Field of Classification Search
USPC ..... 345/55, 98–100, 212, 213; 326/62, 63, 326/80; 327/333
See application file for complete search history.

(56) References Cited

U.S. PATENT DOCUMENTS

2006/0077168 A1* 4/2006 Fujita ..... 345/100
2008/0158450 A1* 7/2008 Tsuruta ..... 349/33

FOREIGN PATENT DOCUMENTS

JP 2004-219682 A 8/2004
JP 2008-164843 A 7/2008

* cited by examiner

*Primary Examiner* — Chanh Nguyen
*Assistant Examiner* — Ram Mistry
(74) *Attorney, Agent, or Firm* — Maschoff Brennan

(57) ABSTRACT

A circuit includes a first logic circuit section that outputs a signal that could be in an active voltage level depending on a transfer-signal input from a shift register throughout a display period and outputs a signal whose voltage is constant at the active voltage level throughout an off sequence period; an enable signal output section that outputs an enable signal that is pulsed during the display period; and a second logic circuit section that outputs a signal corresponding to a logical product of the output signal of the first logic circuit section and the enable signal. The enable signal output section keeps the voltage of the enable signal constant at the active voltage level throughout the off sequence period.

3 Claims, 7 Drawing Sheets

ELECTRO-OPTICAL DEVICE DRIVER CIRCUIT, ELECTRO-OPTICAL DEVICE, AND ELECTRONIC APPARATUS WITH A SHORTENED OFF SEQUENCE

BACKGROUND

1. Technical Field

The present invention relates to an electro-optical device driver circuit used for driving an electro-optical device such as a liquid crystal device, the electro-optical device that is provided with the electro-optical device driver circuit, and an electronic apparatus that is provided with the electro-optical device. An example of the electronic apparatus is a liquid crystal projector.

2. Related Art

In an electro-optical device, a plurality of data lines and a plurality of scanning lines are formed over a substrate as intersecting lines. A pixel including a pixel electrode is formed at a position corresponding to each of the intersections of the data lines and the scanning lines. The pixels are formed in a matrix pattern in a plan view. Each of the pixels includes a pixel-switching element. An example of the pixel-switching element is a thin film transistor (TFT). When the electro-optical device is driven, a scanning signal is supplied from a scanning line driving circuit to each pixel through a scanning line, thereby switching a pixel-switching element ON. When a pixel-switching element is in an ON state, an image signal is supplied to a pixel electrode from a data line via the pixel-switching element.

In such an electro-optical device, off sequence operation is carried out in order to avoid irregular residual charge at a plurality of pixels. The irregular residual charge is a phenomenon that occurs at the time of discontinuing display (when entering an OFF state), for example, when power supply is shut off (power OFF). In the off sequence operation, signals having the same predetermined voltage level (for example, image signal corresponding to black) are supplied to all of the plurality of pixels before power OFF (for example, refer to JP-A-2004-219682 and JP-A-2008-164843). With such off sequence operation, it is possible to practically even out residual charge that would otherwise remain irregularly at a plurality of pixels after power OFF depending on an image having been displayed in a pixel area immediately before the start of the off sequence operation. Therefore, it is possible to avoid an afterimage from being displayed in the pixel area (that is, the occurrence of a so-called "burn-in" phenomenon).

However, there is a technical problem in related art in that it could take long to perform off sequence operation described above (hereinafter referred to as "off sequence time"). For example, in a typical off sequence operation, a plurality of scanning signals is supplied from a scanning line driving circuit sequentially onto a plurality of scanning lines (which means the sequential scanning of the plurality of scanning lines) so as to put a plurality of pixel-switching elements each of which is formed in a pixel into an ON state and, in addition, signals having a predetermined voltage level are supplied onto a plurality of data lines. When off sequence operation is performed in such a way, it takes a comparatively long time to complete the sequential scanning of all of the plurality of scanning lines. This is the reason why there is a possibility that time required for off sequence operation is long. Especially, the larger the number of scanning lines, the longer the off sequence time.

SUMMARY

An advantage of some aspects of the invention is to provide an electro-optical device driver circuit, an electro-optical device, and an electronic apparatus that can shorten off sequence time.

An electro-optical device driver circuit according to a first aspect of the invention has the following features. The electro-optical device driver circuit can be used for driving an electro-optical device that includes a plurality of scanning lines and a plurality of data lines that are formed in a pixel area over a substrate. The electro-optical device further includes a plurality of pixels each of which is electrically connected to a scanning line and a data line. The electro-optical device driver circuit includes a shift register, a reset signal output section, a first logic circuit section, an enable signal output section, and a second logic circuit section. The shift register outputs transfer signals sequentially. The reset signal output section outputs a reset signal whose voltage level is constant at a first voltage level throughout a display period and constant at a second voltage level throughout an off sequence period. The display period is a time period during which an image that should be displayed in the pixel area is displayed. The off sequence period is a time period for putting display in the pixel area into an off state. The second voltage level is different from the first voltage level. The first logic circuit section receives the transfer signals outputted sequentially as an input and the reset signal as another input, outputs a signal that could be in an active voltage level depending on the inputted transfer signal if the voltage level of the reset signal inputted into the first logic circuit is the first voltage level, and outputs a signal whose voltage is constant at the active voltage level if the voltage level of the reset signal inputted into the first logic circuit is the second voltage level. The enable signal output section outputs an enable signal. The second logic circuit section outputs a signal corresponding to a logical product (AND) of the signal outputted from the first logic circuit section and the enable signal outputted from the enable signal output section. The enable signal output section outputs, as the enable signal, a pulse signal that has a predetermined pulse width that is shorter than a pulse width of the transfer signal during the display period. The enable signal output section keeps the voltage of the enable signal constant at the active voltage level throughout the off sequence period.

When the electro-optical device is driven, the electro-optical device driver circuit according to the first aspect of the invention operates as follows. The shift register generates transfer signals and outputs them sequentially on the basis of various timing signals supplied from an external circuit.

The reset signal output section outputs a reset signal. The voltage level of the reset signal in the display period is different from the voltage level of the reset signal in the off sequence period. Specifically, during the display period, the reset signal output section outputs a signal whose voltage value is constant at the first voltage level (for example, a high voltage level or a high potential) as the reset signal. During the off sequence period, the reset signal output section outputs a signal whose voltage value is constant at the second voltage level (for example, a low voltage level or a low potential) as the reset signal. The "off sequence period" is a time period that follows the display period and starts according to the timing of the inputting of instructions for discontinuing display (a command for entering an OFF state) into the electro-optical device during the display period. For example, the off sequence period starts according to the timing of the inputting of a command for powering off the electro-optical device. During the off sequence period, signals having the same predetermined voltage level (e.g., image signal corresponding to black) are supplied to all of the plurality of pixels of the electro-optical device.

The transfer signals outputted sequentially from the shift register and the reset signal outputted from the reset signal output section are inputted into the first logic circuit section. When the voltage level of the inputted reset signal is the first voltage level, the first logic circuit section outputs a signal that takes the active voltage value depending on the inputted transfer signal. When the voltage level of the inputted reset signal is the second voltage level, the first logic circuit section outputs a signal whose voltage value is constant at the active voltage level. Therefore, during the display period, the first logic circuit section outputs a signal that takes the active voltage value depending on the transfer signal (that is, a signal whose voltage value is set at the active voltage level during each time period in which there is a transfer-signal input and at the non-active voltage level during the other time periods). The "active voltage level" is a predetermined voltage potential that is different from the "non-active voltage level", which is another predetermined voltage potential. For example, the active voltage level is a level at which it is possible to put pixel-switching elements provided in pixels into an ON state. The non-active voltage level is a level at which it is possible to put pixel-switching elements provided in pixels into an OFF state. The first logic circuit section includes, for example, NAND circuits into which the transfer signals and the reset signal are inputted.

The enable signal output section outputs, as the enable signal, a pulse signal that has a predetermined pulse width that is shorter than a pulse width of the transfer signal during the display period.

The second logic circuit section outputs a signal corresponding to the logical product of a signal outputted from the first logic circuit section and the enable signal outputted from the enable signal output section to, for example, each of the plurality of scanning lines. Therefore, for example, during the display period, the second logic circuit section limits the pulse width of transfer-signal-dependent signals outputted from the first logic circuit section by means of the enable signal having a predetermined pulse width that is shorter than the pulse width of the transfer signal, and outputs the signals having the limited pulse width as, for example, scanning signals via the scanning lines. Therefore, for example, it is possible to apply an active voltage to the plurality of scanning lines sequentially in accordance with the timing of the outputting of the transfer signals from the shift register during the display period. The second logic circuit section includes, for example, AND circuits into which the signals outputted from the first logic circuit section and the enable signal outputted from the enable signal output section are inputted.

As one feature of the above aspect of the invention, the enable signal output section keeps the voltage of the enable signal constant at the active voltage level throughout the off sequence period. Therefore, during the off sequence period, the second logic circuit section can output signals whose voltage value is constant at the active voltage level by performing logical operation to find the logical product of the signals outputted from the first logic circuit section (i.e., signal whose voltage value is constant at the active voltage level) and the enable signal outputted from the enable signal output section (i.e., signal whose voltage value is constant at the active voltage level). This means that the second logic circuit section can output signals whose voltage value is constant at the active voltage level to the plurality of scanning lines (or the plurality of data lines) at the same time during the off sequence period. Therefore, for example, it is possible to put all of the pixel-switching elements provided in the pixels into an ON state almost at the same time or practically at the same time during the off sequence period. For this reason, in comparison with a case where, for example, scanning signals are sequentially supplied to a plurality of scanning lines during the off sequence period to put the pixel-switching elements of a plurality of pixels into an ON state on a one-scanning-line-at-a-time basis, it is possible to supply signals having a predetermined voltage level to all of the pixel electrodes of the pixels in a shorter period of time. Consequently, it is possible to shorten the off sequence period (in other words, off sequence time).

As explained above, the electro-optical device driver circuit according to the first aspect of the invention can shorten off sequence time.

In the electro-optical device driver circuit according to the above aspect of the invention, preferably, the enable signal output section should output a plurality of signals that is to be supplied through a plurality of signal lines as the enable signal; and the reset signal output section should generate the reset signal by performing logical operation to find a negative logical product (negative AND) of the plurality of output signals supplied through the plurality of signal lines.

In the preferred mode described above, the enable signal output section outputs a plurality of signals that is to be supplied through a plurality of signal lines as the enable signal. The "plurality of signals that is to be supplied through a plurality of signal lines" is, for example, during the display period, a plurality of pulse signals that take the active voltage value during different time periods. The enable signal output section keeps the voltage of each of the plurality of signals that is to be supplied through the plurality of signal lines, that is, the enable signal, constant at the active voltage level throughout the off sequence period. The reset signal output section generates the reset signal by performing logical operation to find the negative AND of the plurality of signals that has been outputted as the enable signal from the enable signal output section and supplied through the plurality of signal lines. That is, the reset signal output section generates the reset signal whose voltage value is constant at the first voltage level throughout the display period and constant at the second voltage level throughout the off sequence period on the basis of the enable signal, which is the plurality of output signals supplied through the plurality of signal lines. Therefore, it is possible to configure the reset signal output section by means of, for example, a NAND circuit, which is a comparatively simple circuit.

An electro-optical device according to a second aspect of the invention is provided with the electro-optical device driver circuit according to the above aspect of the invention, which may included its preferred modes.

Since the electro-optical device is provided with the electro-optical device driver circuit according to the above aspect of the invention, it is possible to shorten off sequence time.

An electronic apparatus according to a third aspect of the invention is provided with the electro-optical device according to the above aspect of the invention, which may be included its preferred modes.

Since the electronic apparatus is provided with the electro-optical device according to the above aspect of the invention, it is possible to embody various kinds of electronic devices that are capable of shortening off sequence time and providing high-quality image display, including but not limited to, a projection-type display device, a television, a mobile phone, an electronic personal organizer, a word processor, a view-finder-type video recorder, a direct-monitor-view-type video recorder, a workstation, a videophone, a POS terminal, a touch-panel device, and so forth. In addition, as another non-limiting application example thereof, an electronic apparatus of this aspect of the invention may be also embodied as an electrophoresis apparatus such as a sheet of electronic paper.

These and other features, operations, and advantages of the present invention will be fully understood by referring to the following detailed description of exemplary embodiments in conjunction with the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, exemplary embodiments of the present invention will now be explained in detail. In the following embodiments of the invention, a liquid crystal device that operates in conformity to a TFT active-matrix driving scheme is taken as an example of an electro-optical device according to an aspect of the invention.

First Embodiment

With reference to FIGS. 1 to 6, a liquid crystal device according to a first embodiment of the invention will now be explained.

First of all, an example of the overall structure of a liquid crystal device according to the present embodiment of the invention is described below while referring to FIGS. 1 and 2.

Figure 1:
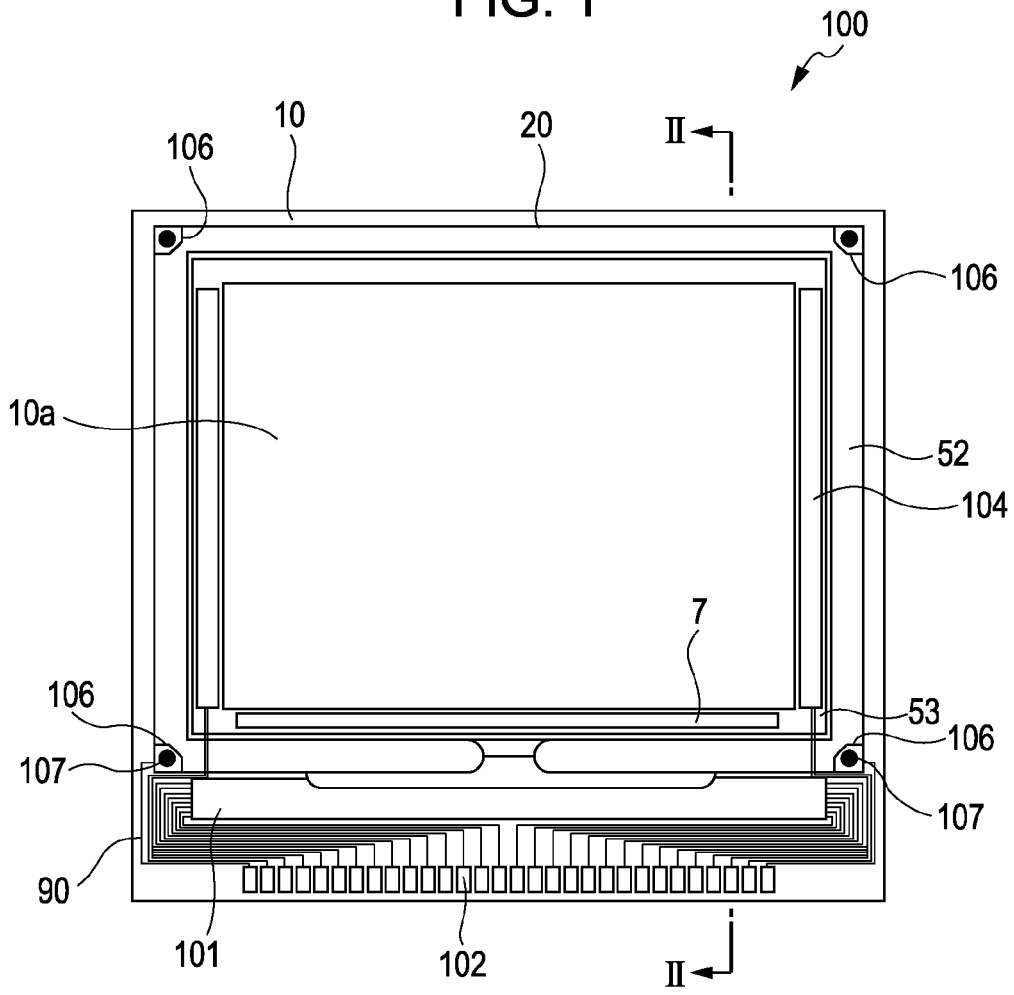
FIG. 1 is a plan view that schematically illustrates an example of the general configuration of a liquid crystal device according to a first embodiment of the invention.

FIG. 1 is a plan view that schematically illustrates an example of the structure of a liquid crystal device according to the present embodiment of the invention. FIG. 2 is a sectional view taken along the line II-II of FIG. 1.

Figure 2:
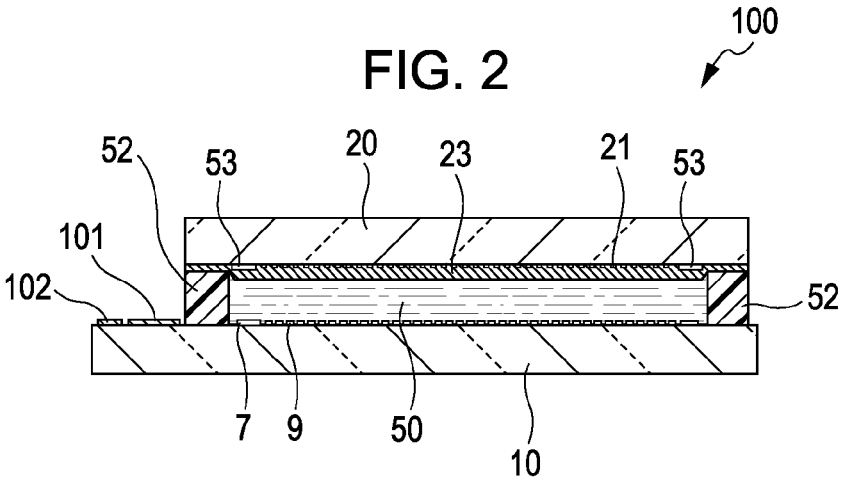
FIG. 2 is a sectional view taken along the line II-II of FIG. 1.

As shown in FIGS. 1 and 2, in a liquid crystal device 100 according to the present embodiment of the invention, a TFT array substrate 10 and a counter substrate 20 are provided opposite to each other. The TFT array substrate 10 is an example of a "substrate" according to an aspect of the invention. The TFT array substrate 10 is, for example, a transparent substrate such as a glass substrate, a quartz substrate, etc., a silicon substrate, or the like. The counter substrate 20 is a transparent substrate such as, for example, a quartz substrate or a glass substrate. Liquid crystal is sealed as a liquid crystal layer 50 between the TFT array substrate 10 and the counter substrate 20.

The TFT array substrate 10 and the counter substrate 20 are bonded to each other with the use of a sealing material 52 that is provided at a sealing area around an image display area 10*a*. The image display area 10*a* is an example of a "pixel area" according to an aspect of the invention. The sealing material 52 is, for example, ultraviolet (UV) curable resin, thermosetting resin, or the like, which is used for bonding these substrates together. In a manufacturing process, the sealing material 52 is applied to the surface of the TFT array substrate 10. Then, it hardens as a result of ultraviolet irradiation, heating, or the like. As a gap material, glass fibers, glass beads, or the like are dispersed in the sealing material 52. The function of the gap material is to set the distance (i.e., inter-substrate gap) between the TFT array substrate 10 and the counter substrate 20 at a predetermined value. In addition to the gap material dispersed in the sealant 52 or as a substitute for the gap material dispersed therein, a gap material may be provided in the image display area 10*a* or in a peripheral area around the image display area 10*a*.

A picture-frame light-shielding film 53, which does not allow light to pass therethrough, is formed on the counter substrate 20 at an area that is located along and inside the sealing area, which the sealant 52 is applied to. The picture-frame light-shielding film 53 defines the picture-frame regional part of the image display area 10*a*. A data line driving circuit 101 and external circuit connection terminals 102 are provided along one of the four sides of the TFT array substrate 10 at a part of a peripheral area outside the sealing area 52*a*, which the sealant 52 is applied to. A sampling circuit 7 is provided in parallel with the one side mentioned above at an area that is located inside the sealing area in such a manner that the picture-frame light-shielding film 53 covers the sampling circuit 7. In addition, a scanning line driving circuit 104 is provided at separate regions that are located inside the sealing area along two of the four sides, more specifically, two sides that are not in parallel with the one side mentioned above, in such a manner that the scanning line driving circuit 104 is covered by the picture-frame light-shielding film 53. Inter-substrate conductive terminals 106, which connect the TFT array substrate 10 with the counter substrate 20 by means of inter-substrate conductive material 107, are provided on the TFT array substrate 10 at positions opposite to the four corners of the counter substrate 20, respectively. With such a structure, it is possible to make the TFT array substrate 10 and the counter substrate 20 electrically connected to each other.

A wiring pattern 90 that provides electric connection between the external circuit connection terminals 102, the data line driving circuit 101, the scanning line driving circuit 104, the inter-substrate conductive terminals 106, though not necessarily limited thereto, is formed on the TFT array substrate 10.

A layered structure that includes pixel-switching TFTs and wirings/lines such as scanning lines and data lines is formed on the TFT array substrate 10 illustrated in FIG. 2. In the image display area 10*a*, pixel electrodes 9 are arranged in a matrix pattern at a layer over the layered structure of the pixel-switching TFTs, the scanning lines, the data lines, and the like. The pixel electrodes 9 are made of ITO (Indium Tin Oxide), which is a kind of a transparent conductive material. An alignment film is formed on the pixel electrodes 9. A light-shielding film 23 is formed on the surface of the counter substrate 20 opposite to the surface of the TFT array substrate 10. The light-shielding film 23 is made of, for example, a metal film having light-shielding property. The light-shielding film 23 is formed in a grid pattern or the like in the image display area 10*a* on the counter substrate 20. A counter electrode 21, which is made of a transparent material such as ITO, is formed on the light-shielding film 23 as a solid electrode all over the area. That is, the solid electrode 21 is formed opposite to the plurality of pixel electrodes 9*a*. An alignment film is formed on the counter electrode 21. The liquid crystal layer 50 is made of liquid crystal that consists of, for example, a single type of nematic liquid crystal or a mixture of more than one type of nematic liquid crystal. Such liquid crystal can be put into a predetermined alignment state for orientation between the pair of alignment films mentioned above.

Though not illustrated in the drawings, a test circuit, a test pattern, etc., for conducting an inspection on the quality, defects, etc., of a liquid crystal device during a manufacturing process or before shipment may be provided on the TFT array substrate 10 in addition to the data line driving circuit 101 and the scanning line driving circuit 104.

Next, with reference to FIGS. 3 and 4, the circuit configuration of a liquid crystal device according to the present embodiment of the invention will now be explained.

Figure 3:
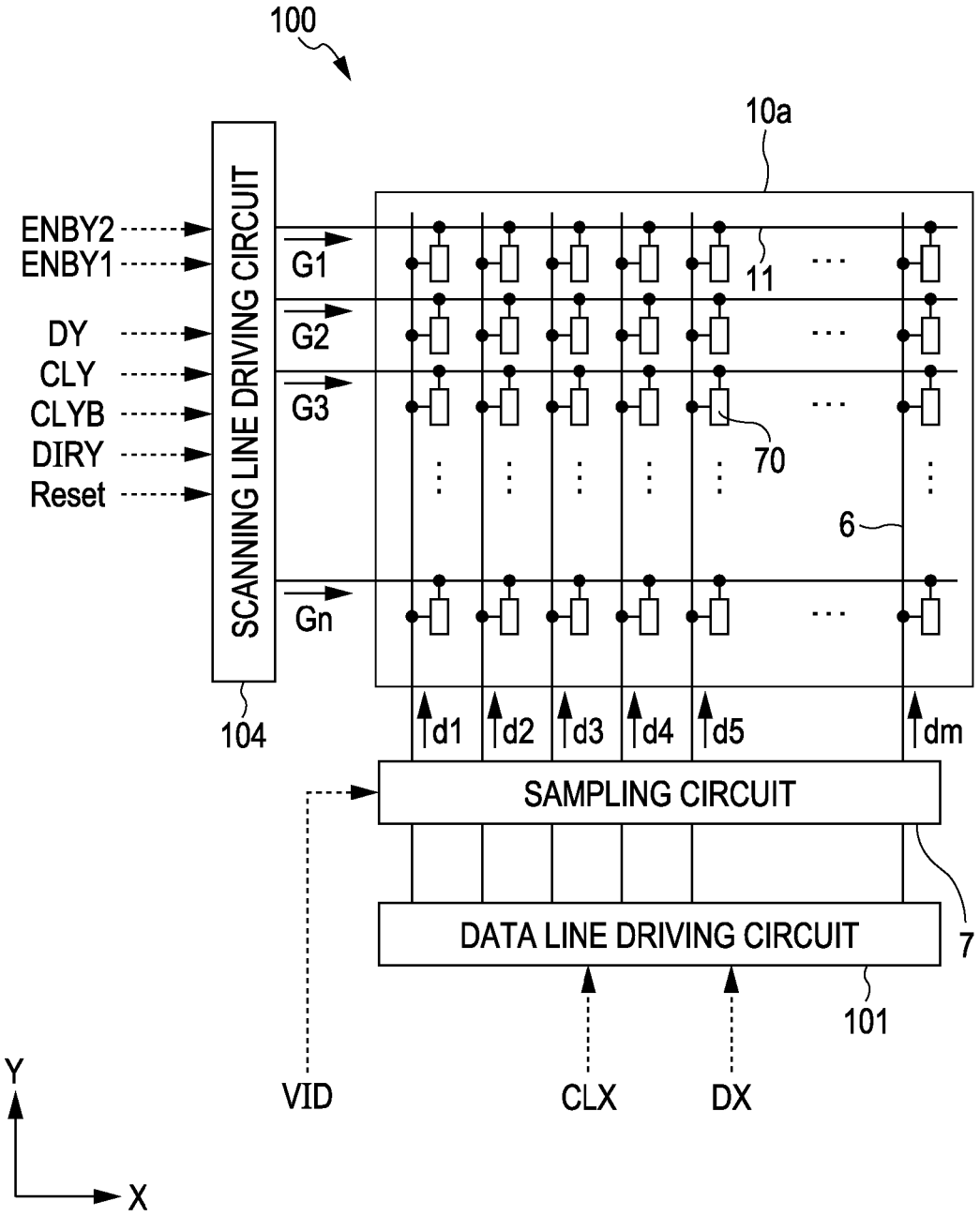
FIG. 3 is a block diagram that illustrates an example of the main circuit configuration of a liquid crystal device according to the first embodiment of the invention.

FIG. 3 is a block diagram that illustrates an example of the main circuit configuration of a liquid crystal device according to the present embodiment of the invention. FIG. 4 is a circuit diagram that schematically illustrates an example of the electric configuration of a pixel.

As illustrated in FIG. 3, the liquid crystal device 100 according to the present embodiment of the invention includes a plurality of pixels 70, a plurality of scanning lines 11, the number of which is denoted as n, and a plurality of data lines 6, the number of which is denoted as m. The plurality of pixels 70, the n scanning lines 11, and the m data lines 6 are formed in the image display area 10*a* over the TFT array substrate 10. The n scanning lines 11 intersect with the m data lines 6. As used herein, each of m and n is a natural number.

The pixels 70 are arranged in the image display area 10*a* in a two-dimensional matrix pattern having n rows and m columns. More specifically, as illustrated in FIG. 3, the matrix of the pixels 70 arranged inside the image display area 10*a* includes the first column, the second column, . . . , and the m-th column counted from the left and the first row, the second row, . . . , and the n-th row counted from the top. That is, the pixel 70 is formed at an area corresponding to each of the intersections of the m data lines 6 and the n scanning lines 11. Each of the pixels 70 functions as a unit display element.

Figure 4:
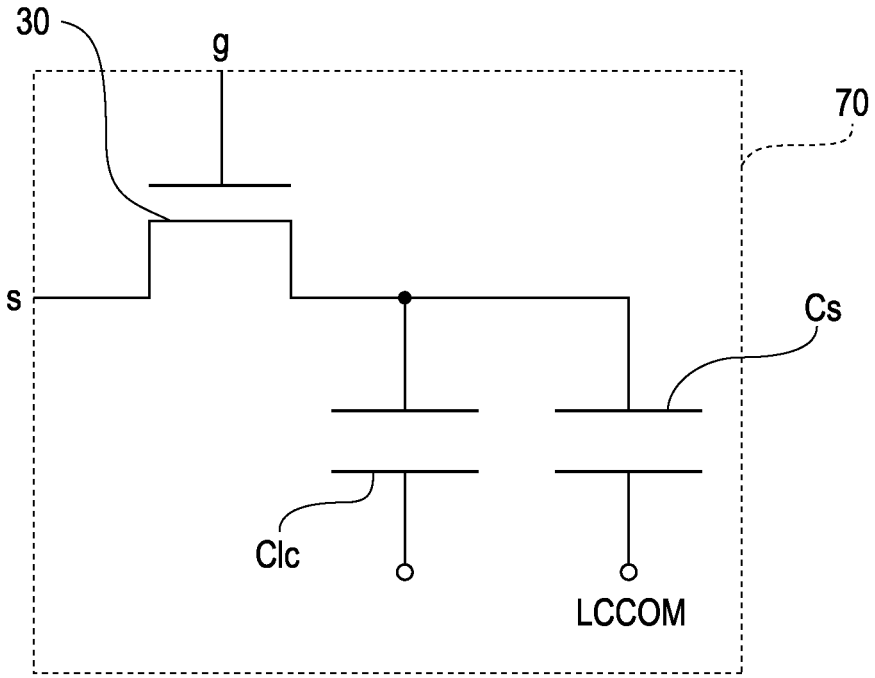
FIG. 4 is a circuit diagram that schematically illustrates an example of the electric configuration of a pixel.

As illustrated in FIG. 4, the pixel 70 includes a TFT 30, a liquid crystal capacitor Clc, and an additional capacitor Cs.

The liquid crystal capacitor Clc corresponds to the capacitance of the pixel electrode 9, the counter electrode 21, and the liquid crystal layer 50 (refer to FIG. 2).

The additional capacitor Cs is electrically connected in parallel with the liquid crystal capacitor Clc.

The source terminal s of the TFT 30 is electrically connected to the data line 6*a*. The gate terminal g of the TFT 30 is electrically connected to the scanning line 11. The operation state of the TFT 30 is switched between ON and OFF in accordance with a scanning signal that is supplied from the scanning line driving circuit 104.

The drain terminal of the TFT 30 is electrically connected to one terminal of each of the liquid crystal capacitor Clc and the additional capacitor Cs. The other terminal of the additional capacitor Cs is electrically connected to a common potential LCCOM. When the TFT 30 is turned on due to an input of a scanning signal to the gate terminal g of the TFT 30, a voltage that is being applied to the source terminal s of the TFT 30 that is electrically connected to the data line 3 is applied to the liquid crystal capacitor Clc and the additional capacitor Cs. The potential of a data signal supplied thereto is held thereat. By this means, it is possible to hold, for a long time, the potential of a data signal supplied to the pixel 70 when image display operation is performed.

Referring back to FIG. 3, the data line driving circuit 101 is configured to output a sampling circuit drive signal for driving the sampling circuit 7 on the basis of a clock signal CLX (and an inversion signal CLXB of the clock signal CLX) and a shift register start signal DX.

The sampling circuit 7 includes a sampling switch that is made up of single-channel-type TFTs, which are either p-channel TFTs or n-single-channel TFTs, or, alternatively, complementary-type TFTs. The sampling circuit 7 samples an image signal VID inputted from an external circuit according to the sampling circuit drive signal, which is a reference clock signal. The sampling circuit 7 outputs the results of sampling as data signals di (i=1, 2, 3, . . . , m) to the m data lines 6. In each column, the data line 6 is electrically connected to the n pixels 70. A data signal supplied through the data line 6 is written into the pixels 70 (more specifically, the liquid crystal capacitor Clc and the additional capacitor Cs of each of the pixels 70).

The scanning line driving circuit 104 generates scanning signals Gi (i=1, 2, 3, . . . , n) on the basis of a clock signal CLY, which is a reference clock for scanning-signal application, (and an inversion signal CLYB of the clock signal CLY) and a shift register start signal DY. The scanning line driving circuit 104 outputs the scanning signals Gi to the plurality of scanning lines 11.

Next, with reference to FIG. 5, the configuration of the scanning line driving circuit 104 will now be explained in detail.

Figure 5:
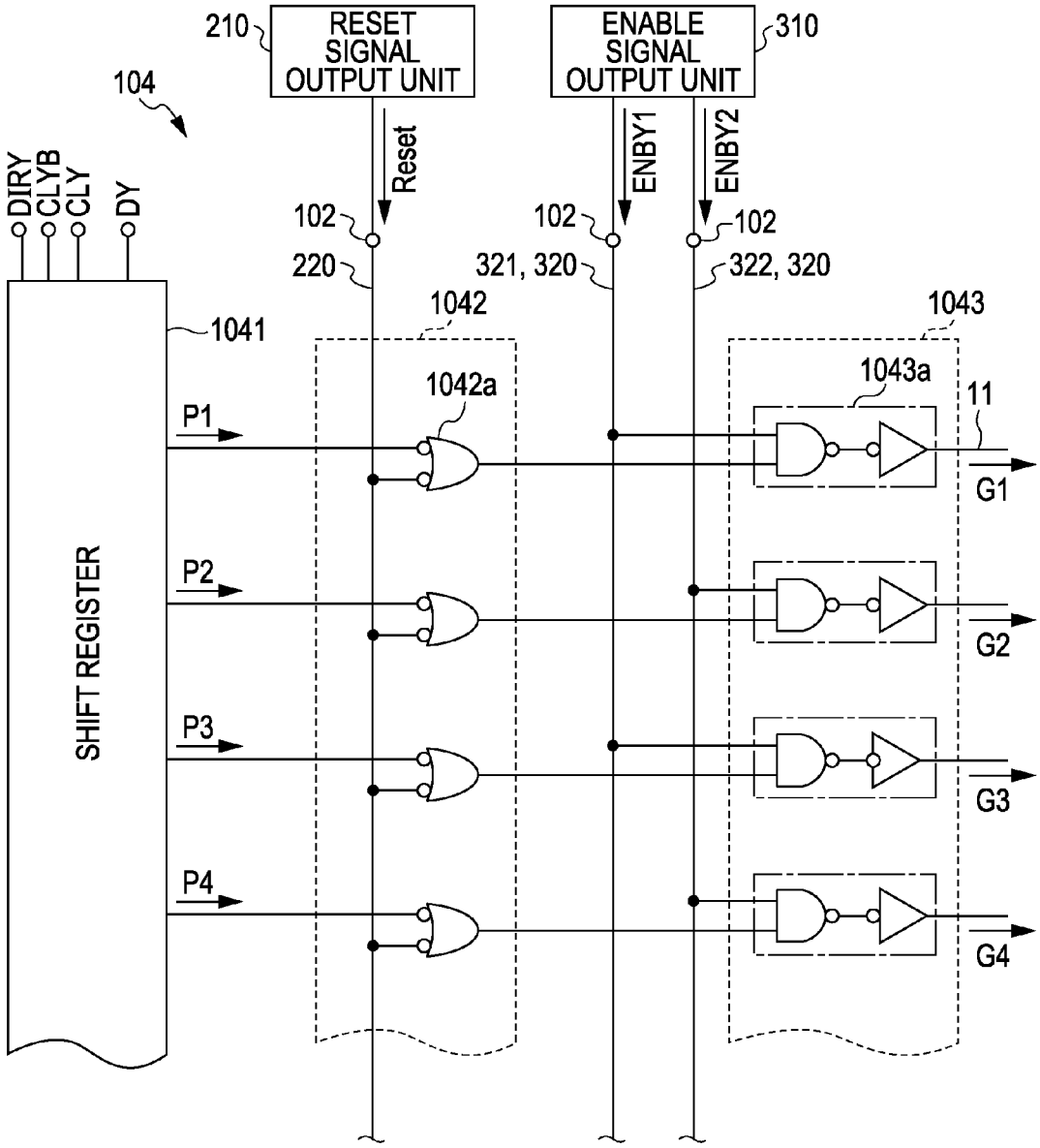
FIG. 5 is a block diagram that schematically illustrates an example of the electric configuration of a scanning line driving circuit according to the first embodiment of the invention.

FIG. 5 is a block diagram that schematically illustrates an example of the electric configuration of the scanning line driving circuit 104.

As illustrated in FIG. 5, the scanning line driving circuit 104 includes a shift register 1041, logic circuit blocks 1042 and 1043, a reset signal line 220, and an enable signal line 320 (that is, enable signal lines 321 and 322).

The shift register 1041 is a bidirectional shift register. Receiving an input of the shift register start signal DY from an external circuit, the shift register 1041 outputs transfer signals Pi (i=1, . . . , n) from a plurality of output stages, the number of which is n, sequentially on the basis of the clock signal CLY (and the inversion signal CLYB thereof) and a direction control signal DIRY that are inputted from an external circuit. The direction control signal DIRY is a signal for controlling the direction of transfer of the shift register start signal DY.

The logic circuit block 1042 includes a plurality of NAND circuits 1042*a*, the number of which is n. The transfer signals Pi outputted from the shift register 1041 are inputted into the NAND circuits 1042*a*, respectively. A reset signal Reset, which is outputted from a reset signal output unit 210 described later, is inputted into the NAND circuits 1042*a* via the reset signal line 220. The NAND circuit 1042*a* outputs a signal corresponding to the negative AND of the transfer signal Pi and the reset signal Reset. That is, when the voltage level of the inputted reset signal Reset is high (H), the logic circuit block 1042 outputs a signal that takes a high voltage value depending on the inputted transfer signal Pi. When the voltage level of the inputted reset signal Reset is low (L), the logic circuit block 1042 outputs a signal whose voltage value is constant at a high level. The high voltage level is a predetermined voltage potential that is higher than the low voltage level. The high voltage level is an example of a "first voltage level" according to an aspect of the invention. The low voltage level is an example of a "second voltage level" according to an aspect of the invention. In the present embodiment of the invention, the high voltage level is an active voltage level at which it is possible to put the TFT 30, which is a pixel-switching element provided in the pixel 70, into an ON state. The low voltage level is a non-active voltage level at which it is possible to put the TFT 30 into an OFF state.

The logic circuit block 1043 includes a plurality of AND circuits 1043*a*, the number of which is n. A signal outputted from the logic circuit block 1042 is inputted into the AND circuits 1043*a* (more specifically, a signal outputted from the corresponding NAND circuit 1042*a* is inputted into each of the AND circuits 1043*a*). In addition, an enable signal ENBY1 or an enable signal ENBY2 is inputted into the AND circuits 1043*a* via the enable signal line 320. The enable signal ENBY1, ENBY2 is outputted from an enable signal output unit 310 as will be described later. The AND circuit 1043*a* outputs a signal corresponding to the logical product (AND) of a signal outputted from the logic circuit block 1042 and the enable signal ENBY1 or the enable signal ENBY2 to the scanning line 11 as the scanning signal Gi. As illustrated in FIG. 5, the AND circuit 1043*a* is made up of a NAND gate and a NOT gate connected to the output terminal of the NAND gate.

The reset signal output unit 210 is provided as a part of the external circuit. The reset signal output unit 210 generates the reset signal Reset and outputs it onto the reset signal line 220 via the external circuit connection terminals 102 (refer to FIG. 1 in conjunction with FIG. 5).

As with the reset signal output unit 210, the enable signal output unit 310 is provided as a part of the external circuit. The enable signal output unit 310 generates the enable signals ENBY1 and ENBY2 and outputs them onto the enable signal line 320 via the external circuit connection terminals 102 (refer to FIG. 1 in conjunction with FIG. 5). More specifically, the enable signal output unit 310 outputs the enable signal ENBY1 onto the enable signal line 321 and outputs the enable signal ENBY2 onto the enable signal line 322.

Next, with reference to FIG. 6 in conjunction with FIG. 5, the operation of the scanning line driving circuit 104, the reset signal output unit 210, and the enable signal output unit 310 during a display period and an off sequence period will now be explained. The term "display period" means a time period during which an image that should be displayed in the image display area 10*a* is displayed. The "off sequence period" is a time period that follows the display period and starts according to the timing of the inputting of instructions for discontinuing display (a command for entering an OFF state) into the liquid crystal device 100 during the display period. For example, the off sequence period starts according to the timing of the inputting of a command for powering off the liquid crystal device 100. During the off sequence period, data signals having the same predetermined voltage level (e.g., image signal corresponding to black) are supplied to all of the plurality of pixels 70 of the liquid crystal device 100.

Figure 6:
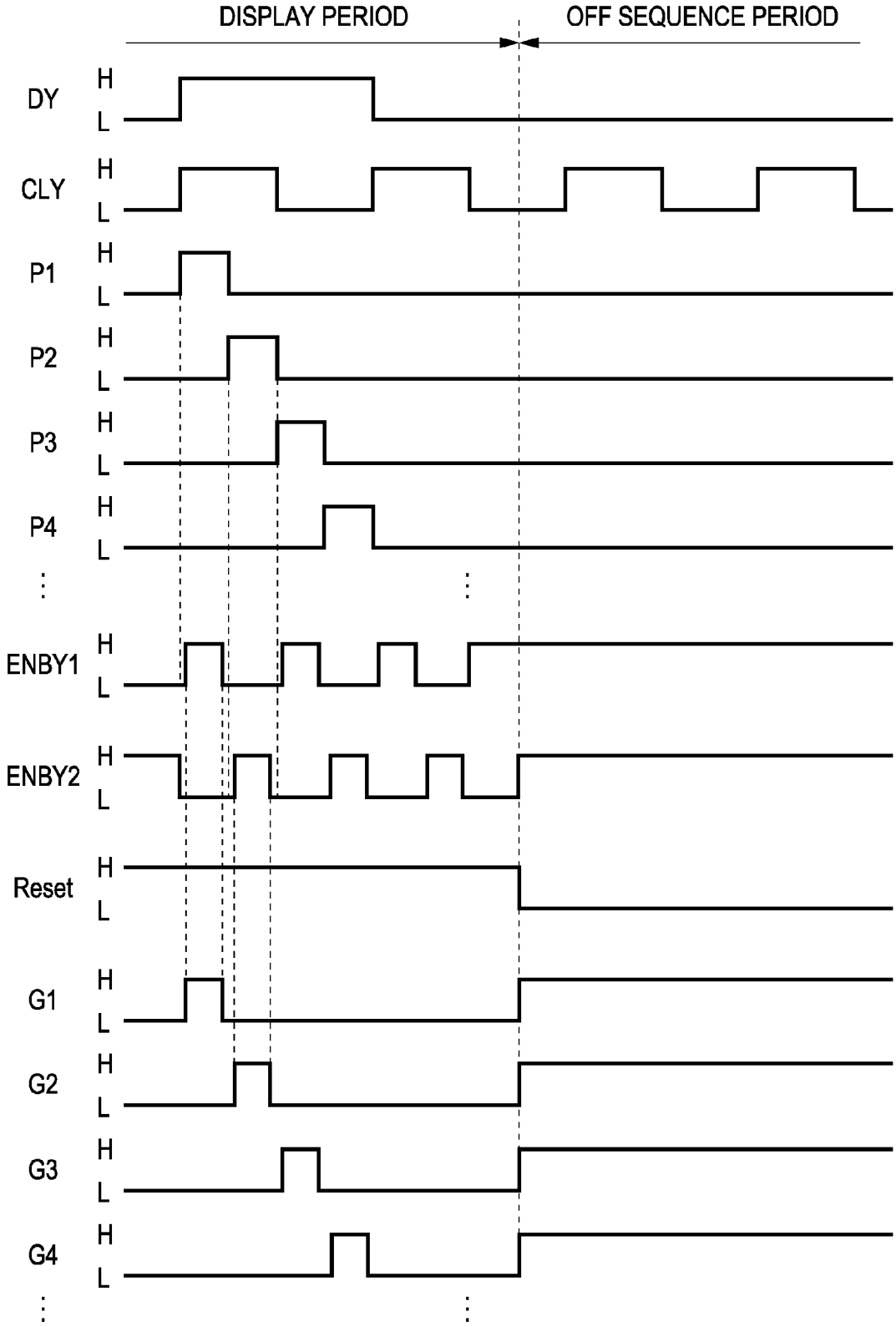
FIG. 6 is a timing chart for explaining the operation of a liquid crystal device according to the first embodiment of the invention during a display period and an off sequence period.

FIG. 6 is a timing chart for explaining the operation of the liquid crystal device 100 according to the present embodiment of the invention during the display period and the off sequence period.

The level pattern of each of the shift register start signal DY, the clock signal CLY, the transfer signals Pi, the enable signals ENBY1 and ENBY2, the reset signal Reset, and the scanning signals Gi during the display period and the off sequence period is illustrated in FIG. 6.

The operation of the scanning line driving circuit 104, the reset signal output unit 210, and the enable signal output unit 310 during the display period is explained first.

Activated by the shift register start signal DY, the shift register 1041 illustrated in FIG. 5 outputs the transfer signals Pi (i=1, . . . , n) from the n output stages sequentially on the basis of the clock signal CLY (and the inversion signal CLYB thereof), and the direction control signal DIRY, which are illustrated in FIG. 6. As illustrated in FIG. 6, the pulse of the transfer signal Pi is half as wide as the pulse of the clock signal CLY.

During the display period, the enable signal output unit 310 outputs, as the enable signal ENBY1, a pulse signal that rises (, which means that the pulse signal switches in its voltage level from low to high) in response to the rise and to the fall of the clock signal CLY and has a pulse width that is shorter than the pulse width of the transfer signal Pi. In addition, during the display period, the enable signal output unit 310 outputs, as the enable signal ENBY2, a pulse signal that has a pulse width that is shorter than the pulse width of the transfer signal Pi and takes a high voltage value during a time period that is not the same as a time period during which the enable signal ENBY1 takes the high voltage value.

During the display period, the reset signal output unit 210 outputs a signal whose voltage value is constant at a high level as the reset signal Reset onto the reset signal line 220. In other words, the reset signal output unit 210 outputs the reset signal Reset having a constant and high voltage level onto the reset signal line 220. That is, the reset signal output unit 210 keeps the voltage value of the reset signal Reset constant at a high level throughout the entire display period. Therefore, a signal that takes a high voltage value depending on the inputted transfer signal Pi is outputted from the logic circuit block 1042. In other words, since the voltage level of the inputted reset signal Reset is high throughout the entire display period, the logic circuit block 1042 outputs the inputted transfer signal Pi as it is. When the transfer signal Pi is inputted into the logic circuit block 1043 from the logic circuit block 1042, the logic circuit block 1043 outputs a signal corresponding to the logical AND of the transfer signal Pi and the enable signal ENBY1 or the enable signal ENBY2 as the scanning signal Gi onto the corresponding scanning line 11.

In this way, the pulsed scanning signals Gi (i=1, . . . , n) are supplied to the n scanning lines 11 sequentially during the display period.

Next, the operation of the scanning line driving circuit 104, the reset signal output unit 210, and the enable signal output unit 310 during the off sequence period will now be explained.

During the off sequence period, the reset signal output unit 210 outputs a signal whose voltage value is constant at a low level as the reset signal Reset onto the reset signal line 220. In other words, the reset signal output unit 210 outputs the reset signal Reset having a constant and low voltage level onto the reset signal line 220. That is, the reset signal output unit 210 switches the voltage level of the reset signal Reset, which was high throughout the entire display period, from high to low. Then, the reset signal output unit 210 keeps the voltage value of the reset signal Reset constant at a low level throughout the entire off sequence period. Therefore, a signal whose voltage value is constant at a high level irrespective of the inputted transfer signal Pi is outputted from the logic circuit block 1042. In other words, since the voltage level of the inputted reset signal Reset is low throughout the entire off sequence period, the logic circuit block 1042 outputs a signal whose voltage value is constant at a high level.

The enable signal output unit 310 keeps the voltage value of the enable signal ENBY1 and the voltage value of the enable signal ENBY2 constant at a high level throughout the entire off sequence period. That is, during the off sequence period, the enable signal output unit 310 outputs a signal whose voltage value is constant at a high level as the enable signal ENBY1, ENBY2 onto the enable signal line 320.

Therefore, during the off sequence period, the logic circuit block 1043 performs logical operation to find the logical AND of the signals inputted into the logic circuit block 1043 from the logic circuit block 1042 (i.e., signal whose voltage value is constant at a high level) and the enable signal ENBY1 or the enable signal ENBY2 (i.e., signal whose voltage value is constant at a high level). By this means, during the off sequence period, the logic circuit block 1043 can output high-level signals to the n scanning lines 11 at the same time. Therefore, for example, it is possible to put all of the TFTs 30, each of which is a pixel-switching element provided in the corresponding one of the plurality of pixels 70, into an ON state almost at the same time or practically at the same time during the off sequence period. For this reason, in comparison with a case where, for example, scanning signals are sequentially supplied to the n scanning lines 11 during the off sequence period to put the TFT 30 of the pixels 70 into an ON state on a one-scanning-line-at-a-time basis, it is possible to supply signals having a predetermined voltage level to all of the pixel electrodes 9 of the pixels 70 in a shorter period of time. Consequently, it is possible to shorten the off sequence period (in other words, off sequence time).

As explained above, the liquid crystal device 100 according to the present embodiment of the invention can shorten off sequence time.

Second Embodiment

Next, with reference to FIG. 7, a liquid crystal device according to a second embodiment of the invention will now be explained.

Figure 7:
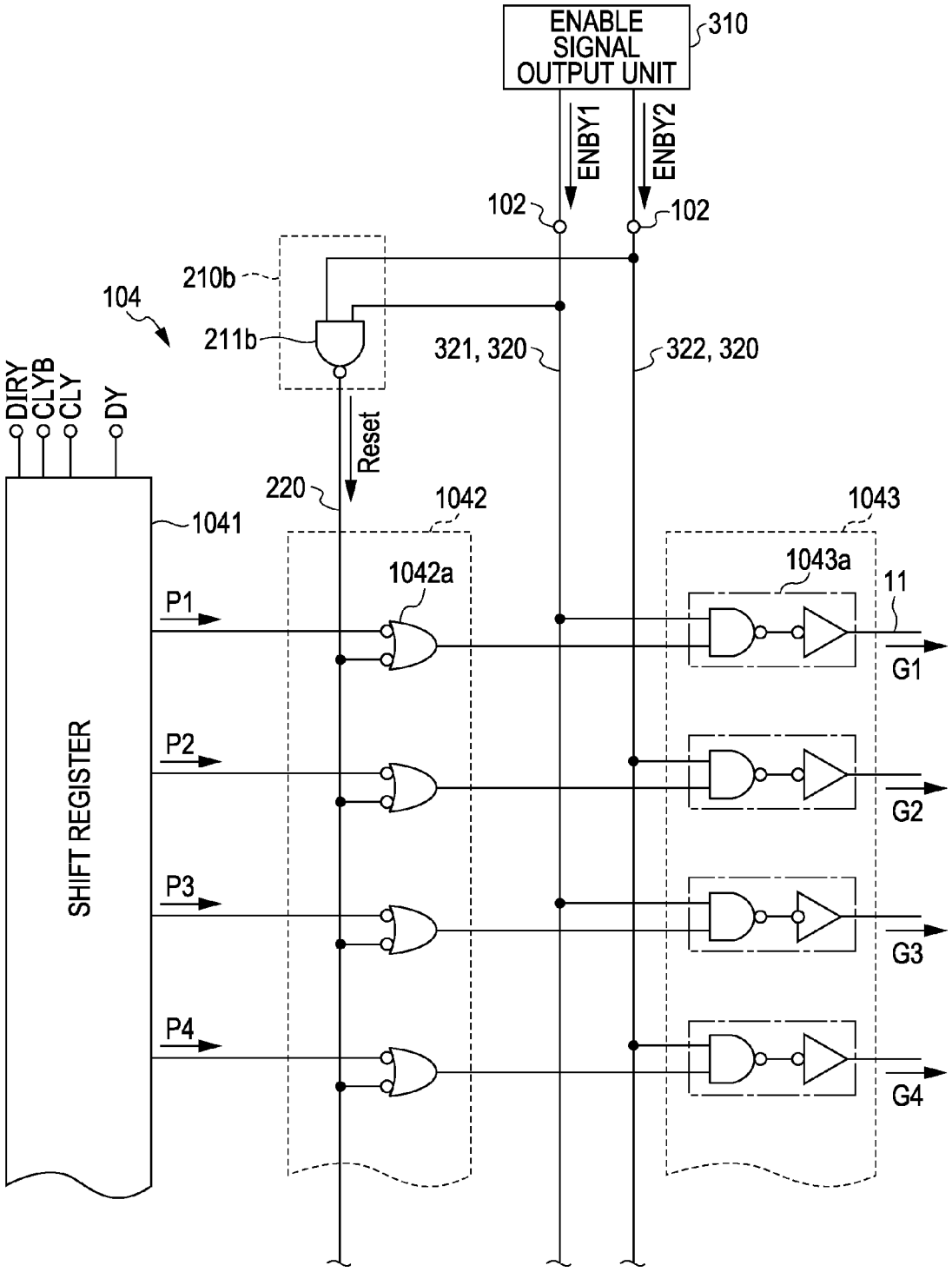
FIG. 7 is a block diagram that schematically illustrates an example of a configuration including a reset signal output unit according to a second embodiment of the invention.

FIG. 7 is a block diagram that schematically illustrates an example of a configuration including a reset signal output unit according to a second embodiment of the invention. In FIG. 7, the same reference numerals are assigned to components that are the same as those disclosed in the first embodiment of the invention, which are illustrated in FIGS. 1 to 5, to avoid redundancy.

As illustrated in FIG. 7, a liquid crystal device according to the second embodiment of the invention is provided with a reset signal output unit 210*b* as a substitute for the reset signal output unit 210 according to the first embodiment of the invention, which is the point of difference between the liquid crystal device according to the second embodiment of the invention and the liquid crystal device 100 according to the first embodiment of the invention. Except for this difference, the configuration of the liquid crystal device according to the second embodiment of the invention is substantially the same as that of the liquid crystal device 100 according to the first embodiment of the invention.

In particular, in the present embodiment of the invention, the reset signal output unit 210*b* includes a NAND circuit 211*b* as illustrated in FIG. 7. The NAND circuit 211*b* is formed over the TFT array substrate 10. The reset signal output unit 210*b* generates the reset signal Reset by performing logical operation to find the negative AND of the enable signals ENBY1 and ENBY2, each of which is outputted from the enable signal output unit 310. Since the enable signals ENBY1 and ENBY2 take a high voltage value alternately during the display period, the voltage value of an output of the reset signal output unit 210*b* is constant at a high level throughout the entire display period. Since both of the voltage value of the enable signal ENBY1 and the voltage value of the enable signal ENBY2 are kept constant at a high level throughout the entire off sequence period, the reset signal output unit 210*b* generates a signal whose voltage value is constant at a low level as the reset signal Reset (refer to FIG. 6) on the basis of the enable signals ENBY1 and ENBY2. Therefore, it is possible to configure the reset signal output unit 210*b* by means of the NAND circuit 211*b*, which is a comparatively simple circuit, and to form it over the TFT array substrate 10 even when an available area is limited. As another advantage, it is not necessary to provide external circuit connection terminals for the reset signal Reset and a wiring pattern through which the reset signal Reset can be supplied from the external circuit connection terminals to the logic circuit block 1042. For this reason, it is possible to reduce the size of the substrate.

Electronic Apparatus

Next, an example of the applications of a liquid crystal device described above, which is an example of an electro-optical device according to an aspect of the invention, to various kinds of electronic apparatuses will now be explained.

Figure 8:
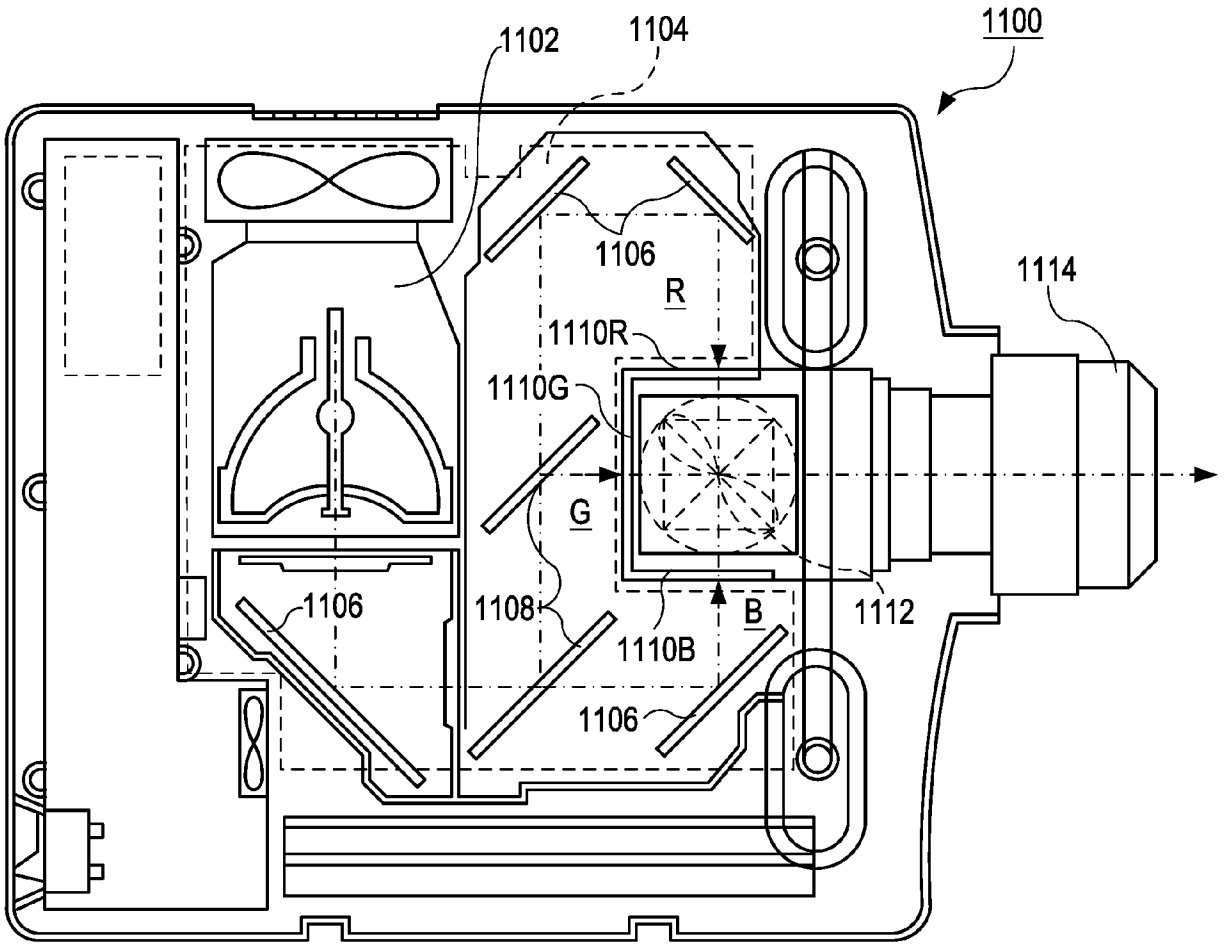
FIG. 8 is a plan view that schematically illustrates an example of the configuration of a projector, which is an example of an electronic apparatus to which an electro-optical device according to an aspect of the invention is applied.

FIG. 8 is a plan view that schematically illustrates an example of the configuration of a projector. In the following description, an explanation is given of a projector that employs the above-described liquid crystal device as a light valve.

As illustrated in FIG. 8, a lamp unit 1102, which is made of a white light source such as a halogen lamp, is provided in a projector 1100. A projection light beam that is emitted from the lamp unit 1102 is separated into three primary color components of R, G, and B by four mirrors 1106 and two dichroic mirrors 1108 arranged in a light guide 1104. The separated primary color components of R, G, and B enter liquid crystal panel 1110R, 1110G, and 1110B, respectively, which function as light valves corresponding to the respective primary color components.

The configuration of the liquid crystal panel 1110R, 1110G, or 1110B is the same as or similar to that of the liquid crystal device described above. Each of these liquid crystal panels 1110R, 1110G, and 1110B is driven by the corresponding one of the primary color signals R, G, and B, which are supplied from an image signal processing circuit. Light subjected to optical modulation by one of these liquid crystal panels enters a dichroic prism 1112 from the corresponding one of three directions. Light of R color component and light of B color component are refracted at a 90-degree angle at the dichroic prism 1112, whereas light of G color component goes straight through the dichroic prism 1112. Therefore, as a result of combination of these color components, a color image is projected on a screen, etc., through a projection lens 1114.

Let us focus on a display image produced by each of the liquid crystal panels 1110R, 1110G, and 1110B. As will be understood, it is necessary to reverse the display image of the liquid crystal panel 1110G in a mirror pattern (that is, to reverse the left side and the right side) with respect to the display images of the liquid crystal panels 1110R and 1110B.

Because light corresponding to each one of the primary colors R, G, and B goes in the corresponding one of the liquid crystal panel 1110R, 1110G, and 1110B thanks to the presence of the dichroic mirror 1108, it is not necessary to provide a color filter thereon.

Among a variety of electronic apparatuses to which the electro-optical device according to an aspect of the invention could be embodied are, in addition to the electronic apparatus explained above with reference to FIG. 8, a mobile-type personal computer, a mobile phone, a liquid crystal display television, a viewfinder-type video recorder, a video recorder of a direct monitor view type, a car navigation device, a pager, an electronic personal organizer, an electronic calculator, a word processor, a workstation, a videophone, a POS terminal, a touch-panel device, and so forth. Needless to say, the invention is also applicable to these various electronic apparatuses without any limitation to those enumerated/mentioned above.

In addition to the liquid crystal device explained in the exemplary embodiments described above, the invention is also applicable to a reflective liquid crystal display which has elements formed on a silicon substrate (LCOS, liquid crystal on silicon), a plasma display (PDP), a field emission display (FED), a surface-conduction electron-emitter display (SED), an organic EL display, a digital micro mirror device (DMD), an electrophoresis apparatus, to name but a few.

The scope of the present invention is not limited to the specific embodiments described above. The invention may be modified, altered, changed, adapted, and/or improved within a range not departing from the gist and/or spirit of the invention apprehended by a person skilled in the art from explicit and implicit description given herein as well as recitation of appended claims. An electro-optical device driver circuit subjected to such modification, alteration, change, adaptation, and/or improvement, an electro-optical device that is provided with such a driver circuit, and an electronic apparatus that is provided with such an electro-optical device are also encompassed within the scope of the invention.

This application claims priority from Japanese Patent Application No. 2010-261129 filed in the Japanese Patent Office on Nov. 24, 2010, the entire disclosure of which is hereby incorporated by reference in its entirely.

What is claimed is:

1. An electro-optical device driver circuit used for driving an electro-optical device including a scanning line and a data line that are formed in a pixel area over a substrate and further including a pixel so as to correspond to a intersection of the scanning line and the data line, comprising:

a shift register that outputs transfer signal;

a reset signal output section that outputs a reset signal whose voltage level is a first voltage level throughout a display period and a second voltage level throughout an off sequence period, the second voltage level being different from the first voltage level;

a first logic circuit section that receives the transfer signal and the reset signal and output a first signal, the first signal comprising an active voltage level depending on the inputted transfer signal if the reset signal is the first voltage level, the first signal is constant at the active voltage level if the reset signal is the second voltage level;

an enable signal output section that outputs an enable signal; and a second logic circuit section that outputs a second signal corresponding to a logical product of the first signal and the enable signal, wherein the enable signal output section outputs, as the enable signal, a pulse signal that has a predetermined pulse width that is shorter than a pulse width of the transfer signal during the display period, and the enable signal output section keeps the voltage of the enable signal constant at an active voltage level throughout the off sequence period, wherein the enable signal output section outputs a plurality of signals that is to be supplied through a plurality of signal lines as the enable signal; and the reset signal output section generates the reset signal by performing logical operation to find a negative logical product of the plurality, output signals supplied through the plurality of signal lines.

2. The electro-optical device that is provided with the electro-optical device driver circuit according to claim 1.

3. An electronic apparatus that is provided with the electro-optical device according to claim 2.

* * * * *